US008272214B2

(12) United States Patent
Mankame et al.

(10) Patent No.: US 8,272,214 B2
(45) Date of Patent: Sep. 25, 2012

(54) SHAPE MEMORY ALLOY CABLES

(75) Inventors: Nilesh D. Mankame, Ann Arbor, MI (US); John Andrew Shaw, Dexter, MI (US); Benjamin Reedlunn, Ann Arbor, MI (US); Alan L. Browne, Grosse Pointe, MI (US); Xiujie Gao, Troy, MI (US); Paul W. Alexander, Ypsilanti, MI (US); Jan H. Aase, Oakland Township, MI (US); Nancy L. Johnson, Northville, MI (US); Kenneth A. Strom, Washington, MI (US); Sanjeev M. Naik, Troy, MI (US); Chandra S. Namuduri, Troy, MI (US); Robin Stevenson, Bloomfield, MI (US); William R. Rodgers, Bloomfield Township, MI (US); John C. Ulicny, Oxford, MI (US); Christopher P. Henry, Thousand Oaks, CA (US); Paul E. Krajewski, Troy, MI (US); Ravindra Brammajyosula, Karnataka (IN)

(73) Assignee: GM Global Technology Operations LLC, Detroit, MI (US)

( * ) Notice: Subject to any disclaimer, the term of this patent is extended or adjusted under 35 U.S.C. 154(b) by 791 days.

(21) Appl. No.: 12/397,482

(22) Filed: Mar. 4, 2009

(65) Prior Publication Data

US 2009/0226691 A1 Sep. 10, 2009

Related U.S. Application Data

(60) Provisional application No. 61/034,884, filed on Mar. 7, 2008, provisional application No. 61/034,913, filed on Mar. 7, 2008.

(51) Int. Cl.
*F01B 29/10* (2006.01)
*F02G 1/04* (2006.01)

(52) U.S. Cl. ..... 60/529; 60/527; 60/528

(58) Field of Classification Search ..... 60/527–529; 174/128.1

See application file for complete search history.

(56) References Cited

U.S. PATENT DOCUMENTS

| | | | | |
|---|---|---|---|---|
| 4,751,821 | A * | 6/1988 | Birchard | 60/698 |
| 5,275,885 | A * | 1/1994 | Ogura | 428/383 |
| 6,543,224 | B1 * | 4/2003 | Barooah | 60/527 |
| 6,732,516 | B2 | 5/2004 | Butera et al. | |
| 7,004,047 | B2 * | 2/2006 | Rey et al. | 74/469 |
| 7,093,416 | B2 * | 8/2006 | Johnson et al. | 57/212 |
| 2004/0265614 | A1 | 12/2004 | Cheung et al. | |
| 2005/0150223 | A1 * | 7/2005 | Rey et al. | 60/527 |
| 2006/0089672 | A1 * | 4/2006 | Martinek | 606/228 |
| 2006/0102378 | A1 | 5/2006 | Johnson et al. | |

FOREIGN PATENT DOCUMENTS

EP 01331392 A2 7/2003

* cited by examiner

*Primary Examiner* — Thomas Denion
*Assistant Examiner* — Christopher Jetton

(57) ABSTRACT

A cable adapted for use as an actuator, adaptive structural member, or damper, includes a plurality of longitudinally inter-engaged and cooperatively functioning shape memory alloy wires.

17 Claims, 5 Drawing Sheets

SHAPE MEMORY ALLOY CABLES

RELATED APPLICATIONS

This patent application claims priority to, and benefit from U.S. Provisional Patent Application Ser. Nos. 61/034,884, entitled "METHODS OF ABSORBING AND DISSIPATING ENERGY UTILIZING ACTIVE MATERIAL CABLES," filed on Mar. 7, 2008; and 61/034,913, entitled "A CABLE COMPRISING AN ACTIVE MATERIAL ELEMENT," filed on Mar. 7, 2008.

BACKGROUND OF THE INVENTION

1. Field of the Invention

The present disclosure generally relates to cables, ropes, braids and other composites comprising a plurality of cooperatively functioning wires (collectively referred to herein as "cables"); and more particularly, to an actuating, adaptive structural, or dampening cable comprising a plurality of shape memory alloy wires.

2. Discussion of Prior Art

Structural tension cables made of natural and synthetic materials have long been developed for a variety of useful applications. For example, cables are used in civil engineering structures for power cables, bridge stays, and mine shafts; in marine and naval structures for salvage/recovery, towing, vessel mooring, yacht rigging and oil platforms; in aerospace structures for light aircraft control cables and astronaut tethering; and in recreation applications like cable cars and ski lifts. Typically, these cables are composed of steel wires helically wound into strands, which, in turn, are wound around a core. Concernedly, however, conventional cables are typically static members incapable of tuning, or otherwise modification where advantageous.

BRIEF SUMMARY OF THE INVENTION

The present invention addresses this concern and presents an active material cable adapted for use as an actuator, adaptive structural member, damper, or the like. Compared to monolithic rods of the same nominal outer diameter, the inventive cable provides better fatigue performance and is more flexible in bending, which, with respect to the latter, allows for more compact spooling (e.g., tighter bending radius).

SMA wire cable construction addresses several concerns associated with producing SMA structural elements at a larger scale, and as such offers advantages over the same. First, it is appreciated that joining conventional SMA material to itself has generally required specialized welding techniques and laser machining to produce complex shapes and mechanical crimping to make attachments to other structures. Moreover, as a monolithic material, SMA presents scaling concerns, including: (1) properties of large-section bars being generally poorer than those of wires due to difficulties in controlling quench rates through the section during material processing and the impracticality of cold work procedures that have been highly optimized for SMA wire, (2) costs associated with large bars of SMA are far greater than those associated with wires, and (3) thermal response time scales with volume-to-surface ratio, i.e. scale with the bar diameter, leading to a sluggish response in large bars.

In a first aspect of the invention, the cable presents a compact, high force, low cost actuator. Here, as previously mentioned, the cable construction provides faster thermal response when compared to rods of the same dimensions, due to better surface/volume ratio of cables. The inventive cable comprises a plurality of longitudinally inter-engaged and cooperatively functioning wires, wherein at least two of the wires comprise shape memory alloy material.

A second aspect of the invention concerns an SMA based cable adapted for use as a dampening element. Here, the SMA wires are in the austenitic phase, where energy is absorbed and dissipated superelastically, and may further compose a deformable structure.

A third aspect of the invention concerns a smart cable actuator comprising the afore-mentioned actuator cable, at least one sensor operable to detect one or more condition, and a controller communicatively coupled to said at least one sensor and cable, and configured to cause the change when the condition is detected.

The disclosure may be understood more readily by reference to the following detailed description of the various features of the disclosure and the examples included therein.

BRIEF DESCRIPTION OF THE SEVERAL VIEWS OF THE DRAWING

A preferred embodiment(s) of the invention is described in detail below with reference to the attached drawing figures of exemplary scale, wherein.

DETAILED DESCRIPTION OF THE INVENTION

Figure 1:
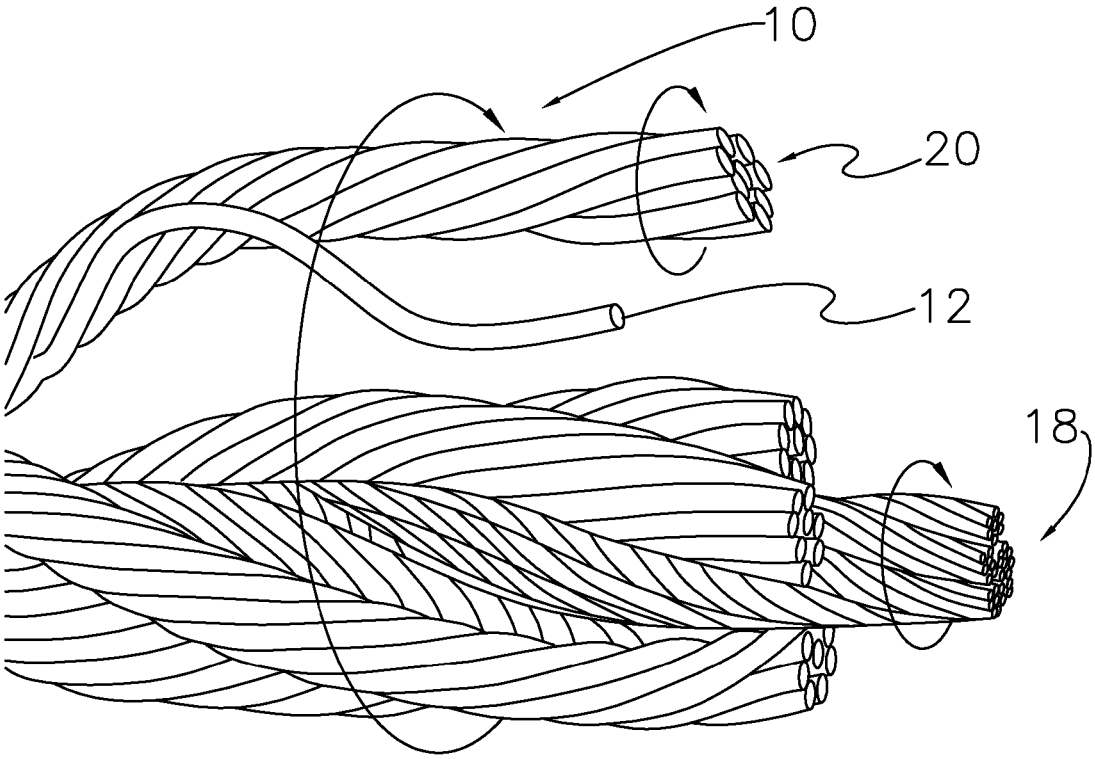
FIG. 1 is a perspective view of the distal end of a cable comprising a plurality of shape memory alloy wires wound into strands, and a plurality of strands wound about a core, in accordance with a preferred embodiment of the invention.

The following description of the preferred embodiments is merely exemplary in nature and is in no way intended to limit the invention, its application, or uses. Referring to FIGS. 1-9, there are illustrated various configurations of a shape memory alloy based cable 10; as previously mentioned, however, it is well appreciated that the benefits of the invention may be utilized variously with other similar geometric forms, such as ropes, braids, bundles, and the like. It is understood that the term "cable" as used herein thereby encompass these other geometric forms, such that the invention general recites a cable 10 comprising a plurality of longitudinally engaged and cooperatively functioning shape memory alloy (SMA) wires 12. Depending upon the phase of the SMA material, the cable 10 may be used as an actuator, adaptive structural member, damper or other application wherein the foregoing functionality and characteristics of the cable 10 is beneficially employed. The invention is described and illustrated with respect to SMA material; however, in some aspects of the invention, it is appreciated that other equivalent active materials, similarly exhibiting of shape memory effect, may be used in lieu of or addition to SMA.

I. Active Material Discussion and Functionality

As used herein the term "active material" shall be afforded its ordinary meaning as understood by those of ordinary skill in the art, and includes any material or composite that exhibits a reversible change in a fundamental (e.g., chemical or intrinsic physical) property, when exposed to or occluded from an activation signal. Suitable active materials for use with the present invention include but are not limited to shape memory materials (e.g., shape memory alloys, ferromagnetic shape memory alloys, and electro-active polymers (EAP), etc.). It is appreciated that these types of active materials have the ability to rapidly displace, or remember their original shape and/or elastic modulus, which can subsequently be recalled by applying an external stimulus. As such, deformation from the original shape is a temporary condition.

More particularly, SMA's generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain. Generally, in the low temperature, or martensite (diffusionless) phase, shape memory alloys exists in a low symmetry monoclinic B19' structure with twelve energetically equivalent lattice correspondence variants that can be pseudo-plastically deformed. Upon exposure to some higher temperature will transform to an austenite or parent phase, which has a B2 (cubic) crystal structure. Transformation returns the alloy element to its shape prior to the deformation. Materials that exhibit this shape memory effect only upon heating are referred to as having one-way shape memory. Those materials that also exhibit shape memory upon re-cooling are referred to as having two-way shape memory behavior.

Shape memory alloys exist in several different temperature-dependent phases. The most commonly utilized of these phases are the so-called Martensite and Austenite phases discussed above. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature ($A_s$). The temperature at which this phenomenon is complete is called the austenite finish temperature ($A_f$).

When the shape memory alloy is in the austenite phase and is cooled, it begins to change into the martensite phase, and the temperature at which this phenomenon starts is referred to as the martensite start temperature ($M_s$). The temperature at which austenite finishes transforming to martensite is called the martensite finish temperature ($M_f$). Generally, the shape memory alloys are softer and more easily deformable in their martensitic phase and are harder, stiffer, and/or more rigid in the austenitic phase. In view of the foregoing, a suitable activation signal for use with shape memory alloys is a thermal activation signal having a magnitude to cause transformations between the martensite and austenite phases.

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating. Active materials comprising shape memory alloy compositions that exhibit one-way memory effects do not automatically reform, and will likely require an external mechanical force if it is judged that there is a need to reset the device.

Intrinsic and extrinsic two-way shape memory materials are characterized by a shape transition both upon heating from the martensite phase to the austenite phase, as well as an additional shape transition upon cooling from the austenite phase back to the martensite phase. Active materials that exhibit an intrinsic shape memory effect are fabricated from a shape memory alloy composition that will cause the active materials to automatically reform themselves as a result of the above noted phase transformations. Intrinsic two-way shape memory behavior must be induced in the shape memory material through processing. Such procedures include extreme deformation of the material while in the martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, active materials that exhibit the extrinsic two-way shape memory effects are composite or multi-component materials that combine a shape memory alloy composition that exhibits a one-way effect with another element that provides a restoring force to reform the original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

It is appreciated that SMA's exhibit a modulus increase of 2.5 times and a dimensional change (recovery of pseudo-plastic deformation induced when in the Martensitic phase) of up to 8% (depending on the amount of pre-strain) when heated above their Martensite to Austenite phase transition temperature. It is appreciated that thermally induced SMA phase changes are one-way so that a biasing force return mechanism (such as a spring) would be required to return the SMA to its starting configuration once the applied field is removed. Joule heating can be used to make the entire system electronically controllable.

Stress induced phase changes in SMA, caused by loading and unloading of SMA (when at temperatures above $A_f$), are two way by nature. That is to say, application of sufficient stress when an SMA is in its austenitic phase will cause it to change to its lower modulus martensitic phase in which it can exhibit up to 8% of "superelastic" deformation. Removal of the applied stress will cause the SMA to switch back to its austenitic phase in so doing recovering its starting shape and higher modulus.

Ferromagnetic SMA's (FSMA's) are a sub-class of SMAs. These materials behave like conventional SMA materials that have a stress or thermally induced phase transformation between martensite and austenite. Additionally FSMA's are ferromagnetic and have strong magnetocrystalline anisotropy, which permit an external magnetic field to influence the orientation/fraction of field aligned martensitic variants. When the magnetic field is removed, the material may exhibit complete two-way, partial two-way or one-way shape memory. For partial or one-way shape memory, an external stimulus, temperature, magnetic field or stress may permit the material to return to its starting state. Perfect two-way shape memory may be used for proportional control with continuous power supplied. One-way shape memory is most useful for rail filling applications. External magnetic fields are generally produced via soft-magnetic core electromagnets in automotive applications, though a pair of Helmholtz coils may also be used for fast response.

Electroactive polymers include those polymeric materials that exhibit piezoelectric, pyroelectric, or electrostrictive properties in response to electrical or mechanical fields. An example of an electrostrictive-grafted elastomer with a piezoelectric poly(vinylidene fluoride-trifluoro-ethylene) copolymer. This combination has the ability to produce a varied amount of ferroelectric-electrostrictive, molecular composite systems. These may be operated as a piezoelectric sensor or even an electrostrictive actuator.

Materials suitable for use as an electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

II. SMA Cable Actuator Description and Use

Figure 7:
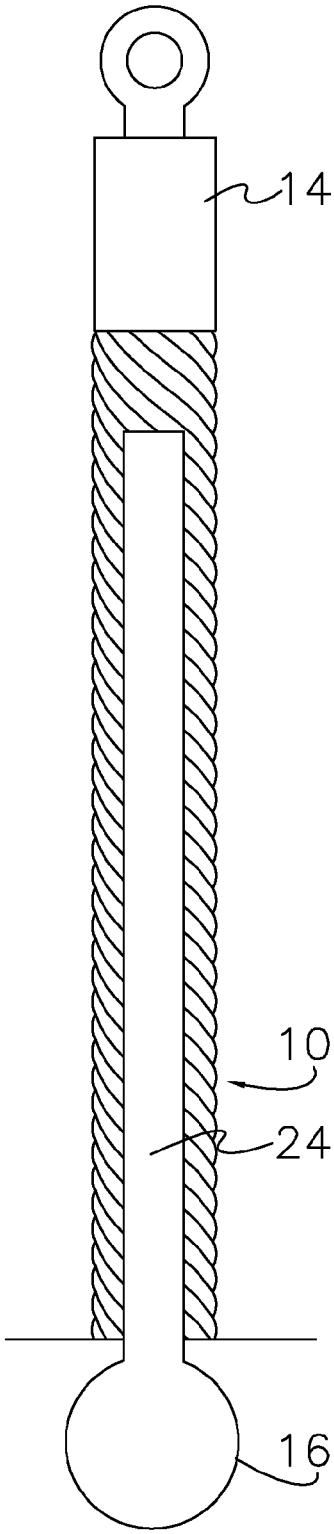
FIG. 7 is an elevation of a cable having a hollow tube core fluidly coupled to a fluid source, in accordance with a preferred embodiment of the invention.

In a first aspect of the invention, the cable 10 may be used as a flexible actuator and/or adaptive structural tension member that is drivenly connectable to a free body 14, such as a crimp that is further adapted for connecting to a structural assembly (FIG. 7). The cable 10 is operable to manipulate (e.g., translate, bend, and/or rotate or "twist") the body 14 to a desired position, orientation, configuration, or shape, when activated. To that end, the cable 10 is configured, relative to the intended function and body mass, to generate sufficient actuating force. Here, it is appreciated that the gauge, cross-sectional area, length, and/or otherwise configuration of the SMA wires 12 necessary to effect the actuation force, based on the active material employed, is readily determinable by those of ordinary skill in the art, and as such, the selection criteria will not be described in detail herein.

In this configuration, the SMA wires 12 are in a normally martensitic phase, so as to be thermally activated; that is to say, the wire material is selected to present a transition temperature above room (or anticipated operating) temperature. As such, the wires 12 are coupled to a thermal signal source 16 (FIGS. 6 and 7) operable to generate and deliver a signal sufficient to activate the material. In other embodiments, it is appreciated that the signal may be electrical, stress related, magnetic, or the like, depending upon the particular active material employed. In the illustrated embodiment, the wires 12 are coupled to the source 16, via hardwire (FIG. 6), fluid flow (FIG. 7), or passively through ambient heat energy (e.g., from the Sun, or from an adjacent exothermic system). It is also appreciated that the wires 12 may be a hybrid of SMA and other durable material, such as steel; a hybrid of superelastic and shape memory SMA; or finally, may present variable SMA constitutions across the cable 10, so as to compensate for differences in wire strains, wire lengths and temperature across the cross-section.

Figure 2:
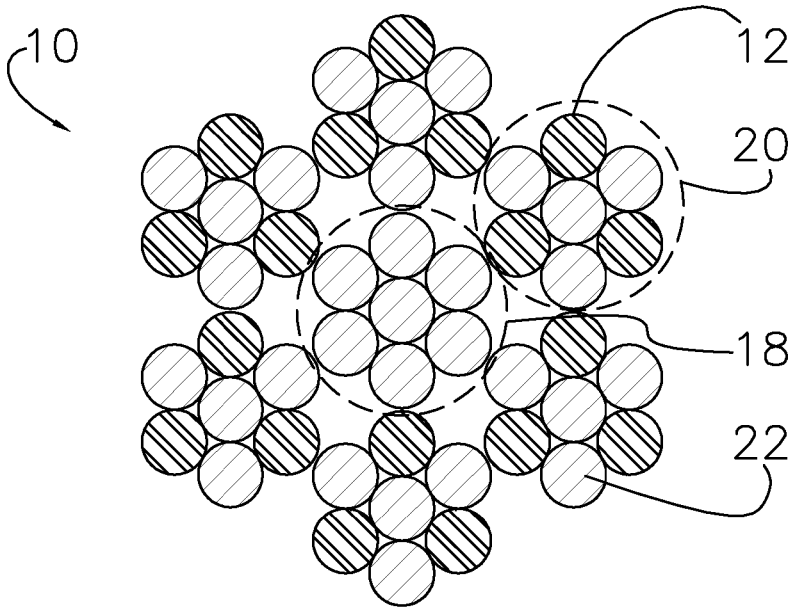
FIG. 2 is a cross-section of a cable comprising a plurality of shape memory alloy and steel wires wound into strands, and a plurality of strands wound about a core, in accordance with a preferred embodiment of the invention.
Figure 3A:
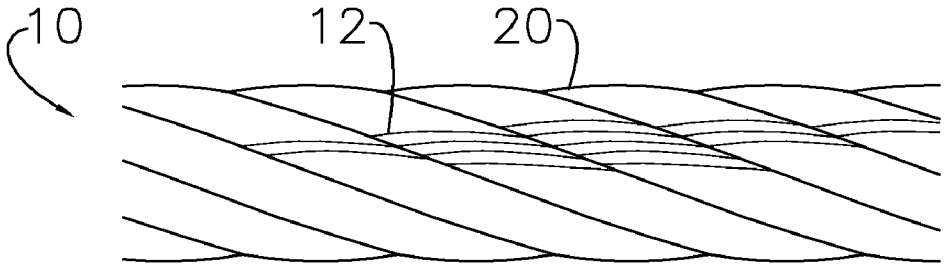
FIG. 3*a* is a elevation of a cable having an outer helix configuration defining an outer right regular lay, in accordance with a preferred embodiment of the invention.
Figure 3B:
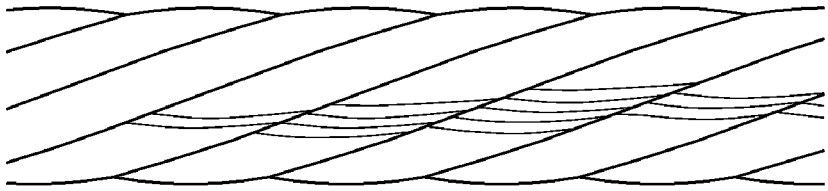
FIG. 3*b* is an elevation of a cable having an outer helix configuration defining an outer left regular lay, in accordance with a preferred embodiment of the invention.
Figure 3C:
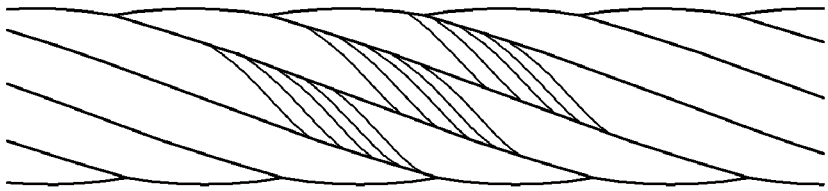
FIG. 3*c* is an elevation of a cable having an outer helix configuration defining an outer right lang lay, in accordance with a preferred embodiment of the invention.
Figure 3D:
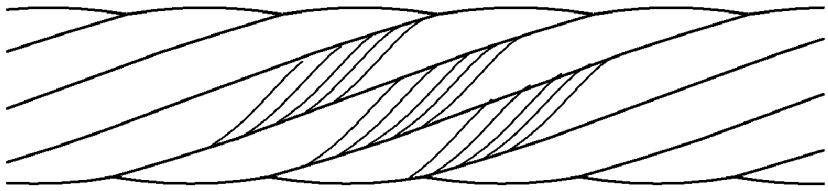
FIG. 3*d* is an elevation of a cable having an outer helix configuration defining an outer left lang lay, in accordance with a preferred embodiment of the invention.
Figure 3E:
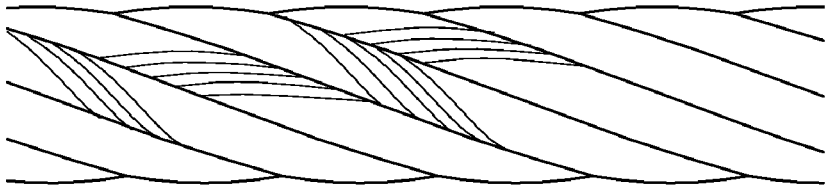
FIG. 3*e* is an elevation of a cable having an outer helix configuration defining an outer right alternate lay, in accordance with a preferred embodiment of the invention.
Figure 4:
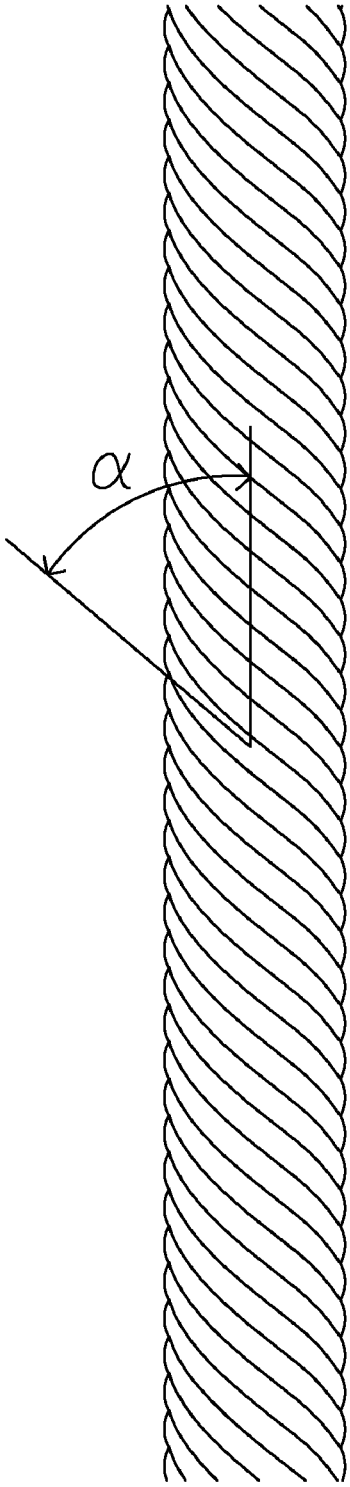
FIG. 4 is an elevation of a cable having an outer helix configuration, particularly defining the helix angle of the strands, in accordance with a preferred embodiment of the invention.

Turning to the structural configuration of the cable 10, various lays and cross-sectional forms are exemplarily depicted in the illustrated embodiments, wherein functionally-graded cross-sections are possible with different wire compositions. FIGS. 1 and 2 show a basic cable design wherein a plurality of wires 12 are helically wound about a core 18, so as to form a strand 20. The core 18 supports the wires of the strand 20 into a nominally circular cross-section (FIGS. 2 and 5). A plurality of strands 20 may then be helically wound about another axial strand 20 or elongated flexible member that serves as the cable core 18 (FIGS. 1 and 2). It is appreciated that the helical strands 20 are the major load bearing elements of the cable 10.

The wires of the cable 10 may consist solely of SMA wires 12 or may further include non-SMA wires 22 (FIG. 2). The non-SMA wires 22 may be included to provide increased structural integrity, act as a return spring, or otherwise tailor the performance of the cable 10. With respect to structural integrity, it is appreciated that the numerous wires 12,22 and strands 20 support tensile loads in parallel, so as to provide redundancy and a more forgiving failure mode.

It is appreciated that the diameters of the SMA wires 12 may be congruent or variable, but are cooperatively configured to generate the required actuation force, while the length(s) of the wires 12 is configured to effect the desired stroke of the actuator 10. With respect to the latter, it is also appreciated that different active lengths, provided, for example, by splicing in electrical, thermal and/or mechanical connections at different points along the cable length, or by differing absolute wire lengths, may be employed to effect differential and proportional actuation. Moreover, the SMA wires 12 may comprise a longitudinal segment of a cable 10 further having conventional longitudinal segments.

The wires 12,22 are preferably preformed by plastic deformation into a helical reference configuration consistent with the desired geometry to avoid the formation of burrs from spring-back of failed wire. In a preferred embodiment, however, the SMA wires 12 may present non-helical permanent shapes, so that upon actuation the cable 10 is caused to experience linear and/or rotational displacement as the wires 12 attempt to achieve the activated non-helical profiles.

More particularly, in the standard cable configurations shown in (FIGS. 4 and 5), each layer 22 of wire 12 in a strand 18, including the exterior wires 12 present congruent helices defining a helix angle, $\alpha$, and direction of lay (it is again noted, however, that the present invention encompasses other geometric forms such as straight bundles, braids, woven ropes, etc.). The helices of the wires 12,22 in a strand 20 versus that of the strands 20 in a given layer 22 can be laid in an opposite sense (regular lay) or in the same sense (lang lay), which affects the angle the wires make with the cable axis. As shown in FIGS. 3*a*-*e*, for example, the outer wire/strand helix configurations may present a right regular, left regular, right lang, left lang, or right alternate lay. It is appreciated that the helix angle and lay help determine the axial stiffness, stored elastic energy, bending/twisting compliance, exterior smoothness, abrasion resistance, and redundancy of the cable 10. For example, it is appreciated that the helix angle is directly proportional to the total stroke of the cable 10, and inversely proportional to its yield load.

The core 18 may be an axis wherein only the inter-twisted layer of wires 12 compose the strand 20; consist of one or more wires 12,22 or strands 20 itself (FIG. 2); or be made of a non-active monolithic member. The core 18 is formed of a suitably flexible and compressible material that among other things enables the cable 10 to achieve the minimum spooling radius and presents strain compatibility. For example, in the present invention, the core 18 may be formed of rubbers, foams, aluminum, copper, plastics, cotton, additional shape memory alloy in either the martensitic or austenitic phase, or combinations of these and other similar materials.

Figure 6:
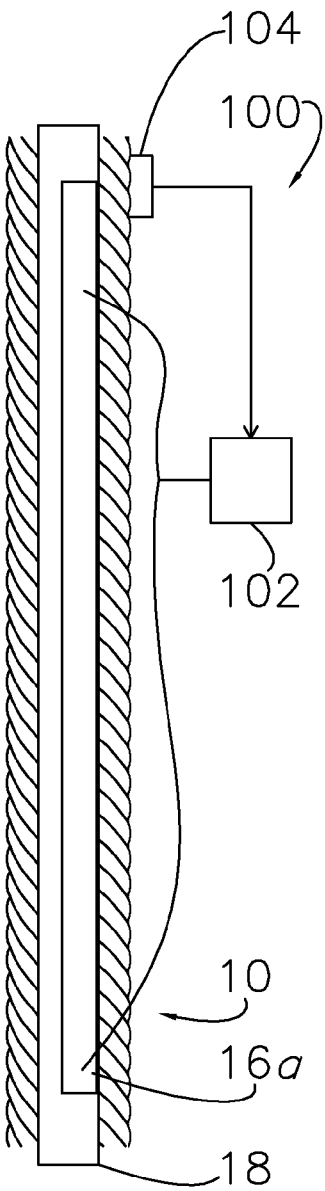
FIG. 6 is an elevation of a smart cable actuator including an SMA based cable shown partially, a thermoelectric element coupled to the core, a controller operatively coupled to the element, and a sensor communicatively coupled to the exterior of the cable and controller, in accordance with a preferred embodiment of the invention.

In a preferred embodiment, the core 18 further presents a heating and/or cooling element configured to actuate or dissipate heat from the remaining strand(s) or wire(s) of the cable 10. In this configuration, the core 18 is formed of thermally conductive material and is thermally coupled to the source 16. For example, and as shown in FIG. 6, the core 18 may be thermally coupled to a thermoelectric element 16*a*. Where Joule heating is to occur, the core 18 is selected, in cooperation with the voltage range of the source 16, to provide a desired resistance that promotes power efficiency; and for example, may comprise at least one Nichrome wire. Alternatively, the core 18 may present a flexible conduit that defines an internal space 24, wherein the space 24 is fluidly coupled to a source 16 operable to direct a heated or cooling fluid into the space 24 (FIG. 7).

Figure 5A:
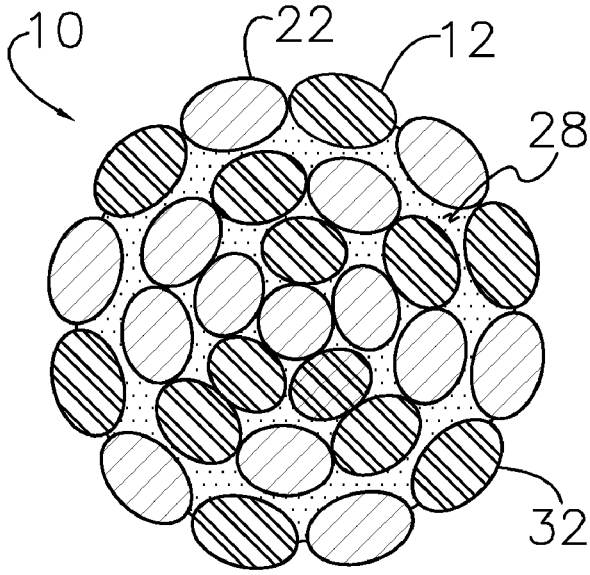
FIG. 5*a* is a cross-section of a cable comprising a plurality of layers of shape memory alloy wires wound about a singular core and presenting coatings, and a lubricant intermediate the wires, in accordance with a preferred embodiment of the invention.

The preferred cable 10 further includes an inter-wire element longitudinally engaged with, intermediate, and operable to modify interaction between at least a portion of the wires 12. Among other things, the element may be a wire surface condition (e.g., texturing), a spacer 26 (FIG. 5*b*), a lubricant 28 (FIG. 5*a*), a sheath 30 (FIG. 5*b*), or a wire coating 32 (e.g., carbon nanotubes as fins, etc) that promotes actuation, facilitates performance, protects the interstitial cable components, or otherwise extends the life of the cable 10. For example, the cable 10 may further include petroleum jelly lubricant 28 to reduce the coefficient of friction between adjacent wires 12,22 (FIG. 5*a*). Where individual strands 20 and/or wires 12,22 are to be separately actuated, the lubricant 28 is preferably thermally and/or electrically insulating. Conversely, to enable more uniform actuation from a single strand 20 or wire 12,22 (e.g., core), the lubricant 28 is thermally and/or electrically conducting.

Figure 5B:
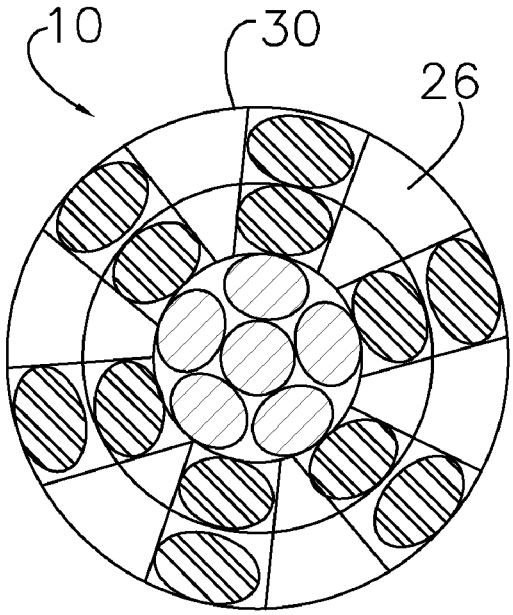
FIG. 5*b* is a cross-section of a cable comprising a plurality of layers of shape memory alloy wires and spacers wound about a singular core, and presenting sheaths intermediate each layer, in accordance with a preferred embodiment of the invention.

In addition to or lieu of lubricant 28, the wires 12,22 may be coated or treated, so as to present a desired surface condition (FIG. 5*a*). A coating 32 may be applied, for example, to modify (e.g. improve) fatigue/thermo-mechanical interface properties. Moreover, the surface condition may be configured to modify the coefficient of friction between adjacent wires 12. Alternatively, it is appreciated that a sheath 30, e.g., of Teflon™ 66, may be used to cover individual SMA strands 20 or wires 12,22 (FIG. 5*b*). It is appreciated that the response of the cable 10 is tailored by modifying the frictional contribution from strand/wire to strand/wire. Further, the coating 32 may be used to modify emissivity or otherwise heat transfer properties of the wire 12. Lastly, it is appreciated that a (e.g., light, EMF, etc.) sensitive coating 32 may be longitudinally engaged and used in conjunction with a suitable (e.g., fiber optic, etc.) core 18, such that the passage of light or other medium causes the coating 32 to generate heat energy.

As further shown in FIG. 5*b*, longitudinal spacers 26 attached to the core 18 and/or throughout the strands 20 may be provided, for example, to aid or hinder heating or cooling by modifying or preventing wire interaction.

In operation, the cable 10 is preferably part of a smart cable actuator system 100 that further includes a controller 102 intermediately coupled to the source 16 and SMA wires 12, and at least one sensor 104 communicatively coupled to the controller 102 (FIG. 6). The preferred controller 102 is programmably configured to selectively cause the wires 12 to be exposed to the signal. For example, the controller 102 may be configured to activate the wires 12 for a predetermined period (e.g., 10 seconds) upon receipt of a predetermined demand. The controller 102 is preferably configured to individually control each wire 12, which results in the ability to vary the actuation force. In a preferred embodiment, the system 100 includes and the controller 102 is operatively coupled to a cooling device (not shown) operable to reduce the temperature of, so as to accelerate deactivation of the wires 12.

The sensor 104 is operable to detect a condition of interest (e.g., strain, temperature, displacement, electrical resistance, current, voltage, or force), and is communicatively coupled and configured to send a data signal to the controller 102. The controller 102 and sensor 104 are cooperatively configured to determine when an actuating or deactivating situation occurs, either when the condition is detected, or a non-compliant condition is determined, for example, through further comparison to a predetermined threshold. In a preferred mode, the controller 102 may be configured to deactivate the cable 10, where the temperature or strain in the cable 10, as detected by the sensor 104, exceeds the safe operating range of the SMA wires 12. It is appreciated that the sensor 104 and cable 10 may be integrally formed. For example, the cable 10 may present a fixedly secured exterior coating 32 formed of material whose resistance is proportional to the temperature and/or strain being experienced. Thus, by monitoring the resistance, the temperature and/or strain in the cable 10 can be determined.

The cable 10 may be applied to present a smart structural member adapted to modify the local and/or global geometry and/or stiffness of the overall structure, such as with respect to a pre-stressed concrete girder; or to provide valuable information, for example, where used for built-in temperature sensing.

III. SMA Cable Damper Description and Use

Figure 8A:
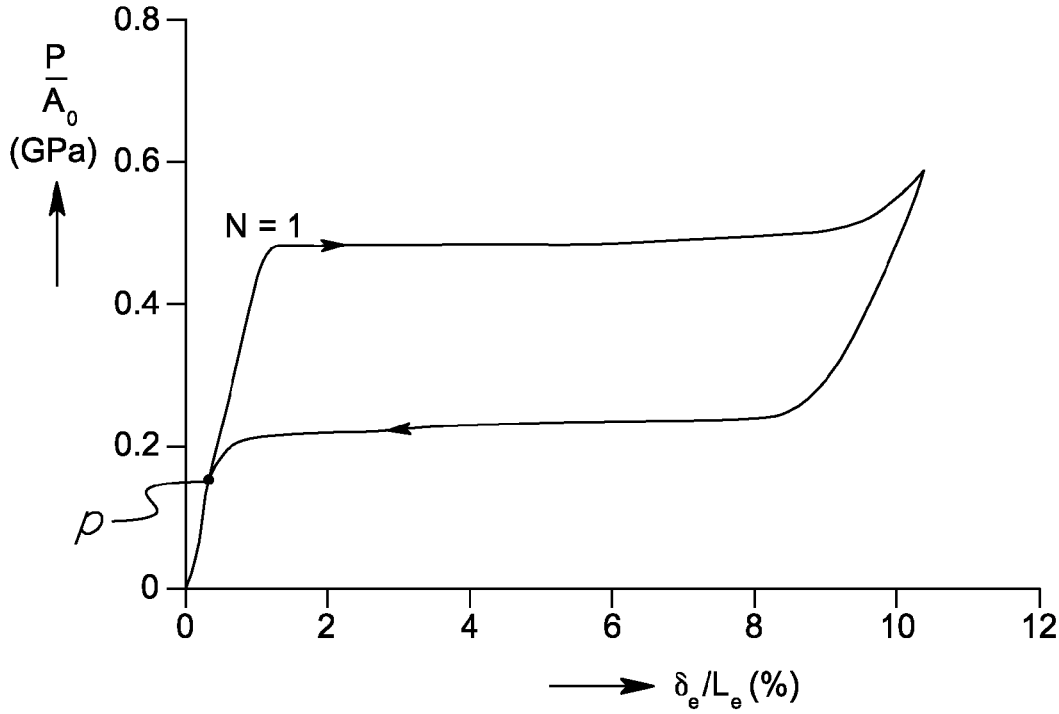
FIG. 8*a* is a hysteresis loop showing the strain versus applied stress relationship of a cable defining shallow wire/strand helix angles as shown in FIG. 3*a,b*, in accordance with a preferred embodiment of the invention.

In another aspect of the invention, the cable 10 may be used as a dampening or energy absorbing element that may be used, for example, in vibration suppression and seismic protection of civil engineering structures. In this configuration, the SMA wires 12 are in a normally austenitic phase; that is to say, the wires 12 present transition temperatures below room or anticipated operating temperatures. As such, the wires 12 generally exhibit superelastic behavior, wherein the term "superelastic" refers to the material's ability to recover strains during a mechanical load/unload cycle, usually via a hysteresis loop (FIGS. 8*a,b*). Otherwise, the construction of the dampening cable 10 is similar to the afore-described structural configuration of the actuator cable 10 (FIGS. 1-7).

Figure 9:
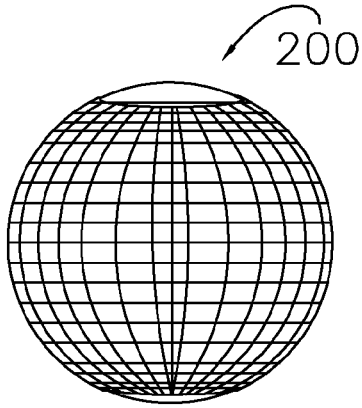
FIG. 9 is a perspective view of a spherical structure comprising a plurality of shape memory alloy cables, in accordance with a preferred embodiment of the invention.

In this configuration, a plurality of cables 10 may be used to compose a tunable energy absorbing structure 200, such as a collapsing shell or ball (FIG. 9). In that sense, it is appreciated that the crushing characteristics of the structure (e.g., ball) can be changed by activation, such that the SMA cables 10 are used to tailor a crash response. The geometry of the structure 200 and the superelastic transformation in the cables 10 cooperate to more efficiently absorb and dissipate energy.

Figure 8B:
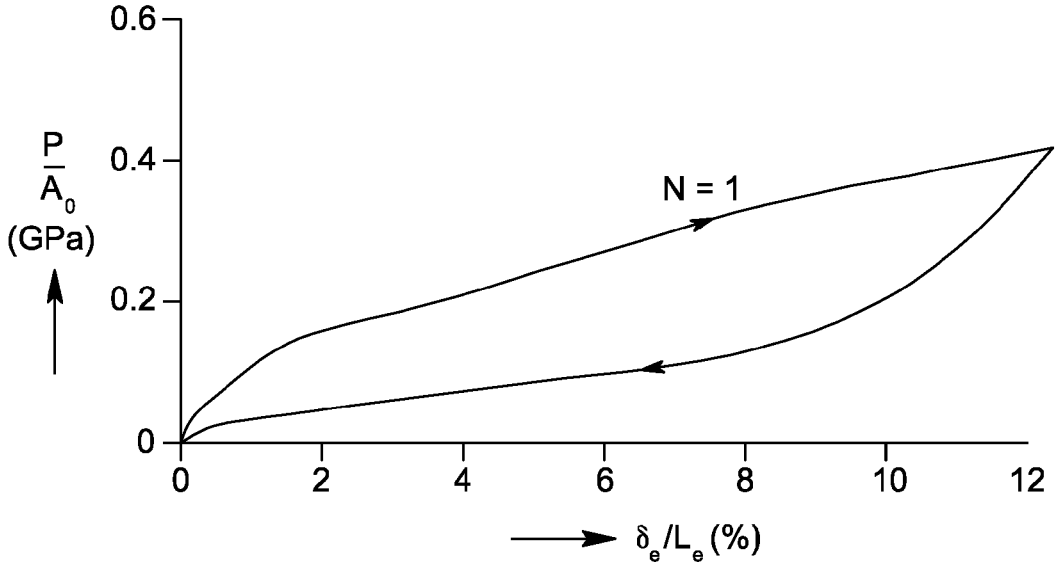
FIG. 8*b* is a hysteresis loop showing the strain versus applied stress relationship of a cable defining a greater helix angle as shown in FIG. 4, in accordance with a preferred embodiment of the invention.

More particularly, and as shown in FIGS. 8*a,b*, it is appreciated that the super-elastic cable 10 absorbs energy as it is initially stretched in the austenitic phase, caused to transition to the martensitic phase, and then further stretched in the martensitic phase; when the load is released the cable 10 releases energy by contracting in the martensitic phase, transitioning back to the Austenitic phase, and further contracting back to its parent austenitic shape. The difference in energy is that area bound by the loop shown in FIG. 8*a*, which is the energy dissipation provided by the system. In FIG. 8*b*, a similar hysteresis loop and energy dissipation volume is produced by a cable having a lower yield load but greater strain capability.

In one embodiment, the structure(s) 200 may be deployable when energy absorption and dissipation is desired, and retained in a storage space (not shown) at other times. The structure 200 is preferably stored in the contracted state (the top of the hysteresis loop), and expanded to the larger energy absorbing configuration when deployed. Moreover, deployment may be tailored such that the as-deployed structure 200 can absorb a specified max energy; for example, where the structure 200 may be a cage adapted to act as a pseudo-bumper ahead of an actual vehicle bumper, the structure may be variably deployable based on the expected severity of the impact event.

As a damper, it is appreciated that the cable 10 has a wide range of applications including as a shock absorbing or jerk limiting cable for load transmission. Here, for example, the cable 10 may be used for towing a trailer (not shown), or to lift heavy loads with a crane (also not shown). Upon loading, the SMA material is preferably retained at a point, p, along the hysteresis loop just fore of transition, so that any additional strain (e.g., from slewing) is operable to immediately begin transitioning the material to the martensitic phase. If slewing stops before complete transformation occurs, it is appreciated that energy dissipation will be proportional to the depth of the incomplete loop achieved.

It is further appreciated that the cable 10 may be used as a power transmission element for remote flexible actuation (e.g., grinders, etc.), or as a belt tensioner. With respect to the latter, a belt (e.g., chain, etc.) drive (not shown) may comprise at least one oversized martensitic SMA segment, e.g., formed by a looped cable 10. The segment is heated to shrink it into operating condition. It can be reheated later to take up slack in other parts of the drive. Alternatively, the segment can be in its superelastic austenitic phase. The superelastic SMA segment can be used to ensure constant tension in the belt even after prolonged use; as it is appreciated that where the belt develops a slack due to wear etc., and decreases the tension in the belt, the stretched SMA segment will contract back to reduce the slack and potentially, keep the belt tension constant.

In another example, at least one and more preferably a plurality of interwoven superelastic cables 10 can be used to dissipate energy during impact events, and in one embodiment may be used in bullet-proof vests. Here, again, the cables 10 are preferably pre-strained so as to be retained just fore the transition point of the hysteresis loop. Upon impact, the bullet or otherwise projectile causes further local strain and a shock wave to disseminate throughout the vest. In another embodiment, the cable 10 may form a structural member of a vehicle (not shown) and be oriented and configured so as to absorb energy upon impact. That is to say, energy is absorbed and dissipated, incrementally as the cable 10 experiences the undulating stress wave generated by the impact, and in total as the cable 10 is caused to undergo a tensile load/unload by the overall impact and recoil of the foreign object. Lastly, it is appreciated that, in superelastic mode, SMA may provide benefits such as stabilization for restraining structures (e.g., bridges, communication towers, guy-ropes, etc.), and as vibration mounts/isolators for ropes or in combination with seat and suspension struts. In the latter, wire friction also contributes to the overall energy dissipation, and the superelastic loop is tailored to maximize dissipation.

Finally, it is appreciated that the structure 200 may further include martensitic (or shape memory) SMA wires 12 configured to modify the profile or geometric shape of the structure 200 when activated, so that the energy absorption and dissipation capability of the structure 200 is increased.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Also, as used herein, the terms "first", "second", and the like do not denote any order or importance, but rather are used to distinguish one element from another, and the terms "the", "a", and "an" do not denote a limitation of quantity, but rather denote the presence of at least one of the referenced item. All ranges directed to the same quantity of a given component or measurement is inclusive of the endpoints and independently combinable.

What is claimed is:

1. A cable adapted for use as an actuator, adaptive structural member, or damper, said cable comprising:

a plurality of longitudinally inter-engaged and cooperatively functioning wires, wherein at least two of the wires comprise shape memory alloy material operable to undergo a reversible change, when exposed to and/or occluded from an activation signal, wherein a portion of the wires presents a core, the remaining wires are longitudinally engaged to the exterior of the core, and said at least two wires are in the normally martensitic phase, present differing active lengths and are longitudinally engaged to the exterior of the core, so as to generate an actuation force, at differing longitudinal points.

2. The cable as claimed in claim 1, wherein said at least two wires are in the normally martensitic phase and produce an actuating force operable to cause the cable to contract, bend, and/or twist as a result of the change.

3. The cable as claimed in claim 2, wherein a portion of the wires are operable to produce a return force antagonistic to the actuating force.

4. The cable as claimed in claim 1, wherein the wires are elastic and the shape memory alloy material is in a normally austenitic phase, so as to be caused to change when exposed to and/or occluded from a stress activation signal.

5. The cable as claimed in claim 1, wherein said at least two wires present a differing attribute, so as to non-concurrently and/or non-congruently change when exposed to or occluded from the signal.

6. The cable as claimed in claim 5, wherein the differing attribute is selected from the group consisting essentially of differing compositions of shape memory alloy material, differing diameters, and differing pre-strains.

7. The cable as claimed in claim 1, further comprising an inter-wire element longitudinally engaged with, intermediate, and operable to modify interaction between at least a portion of the wires.

8. The cable as claimed in claim 7, wherein the element is selected from the group consisting of a wire surface texture, a spacer, a lubricant, a sheath, and a wire coating.

9. The cable as claimed in claim 7, wherein said at least two wires are in the martensitic phase, and the element is thermally and/or electrically non-conductive, so as to thermally and/or electrically isolate said at least portion.

10. The cable as claimed in claim 1, wherein the core is formed of material selected from the group consisting essentially of Nichrome, rubbers, hard foams, aluminum, copper, plastics, cotton, fiber optic material, and shape memory alloy.

11. The cable as claimed in claim 1, wherein the core is hollow, so as to define an interior space, and the cable further comprises a fluid source communicatively coupled to the space and configured to deliver a heated or cooling fluid into the space, so as to thermally activate said at least two wires when in the martensitic phase, or dissipate heat energy from said at least two wires when in the austenitic phase, respectively.

12. The cable as claimed in claim 1, wherein the core is thermally coupled to a thermoelectric element, and the thermoelectric element is configured to heat and/or cool the core.

13. The cable as claimed in claim 1, wherein at least a portion of the remaining wires are wrapped about the exterior of the core in a first direction, so as to present a helix defining a helix angle, and a first outer strand surface.

14. The cable as claimed in claim 13, wherein a portion of the remaining wires are further wrapped about the first surface in a second direction, so as to present a second helix defining a second helix angle, and the first direction or angle differs respectively from the second direction or angle.

15. A smart cable actuator comprising: a cable formed of a plurality of longitudinally inter-engaged and cooperatively functioning wires, wherein at least two of the wires comprise shape memory alloy material that present differing active lengths so as to generate an actuation force at differing longitudinal points and are operable to undergo a reversible change when exposed to and/or occluded from an activation signal; at least one sensor operable to detect one or more condition; and a controller communicatively coupled to said at least one sensor and cable, and configured to cause and/or control the extent of the change when the condition is detected, wherein the controller is individually coupled to, so as to separate cause, each of said at least two wires to change.

16. The actuator as claimed in claim 15, wherein the sensor is selected from the group consisting essentially of a strain, temperature, displacement, electrical resistance, current, voltage, or force gauge.

17. The actuator as claimed in claim 15, wherein the cable and sensor are integrally formed.

* * * * *